US005749037A

United States Patent [19]

Takayuki

[11] Patent Number: 5,749,037

[45] Date of Patent: May 5, 1998

[54] FIXING DEVICE WITH CLEANING DEVICE FOR CLEANING FIXING ROLLER

[75] Inventor: Seki Takayuki, Tokyo, Japan

[73] Assignee: Ricoh Company, Ltd., Tokyo, Japan

[21] Appl. No.: 615,438

[22] Filed: Mar. 14, 1996

[30] Foreign Application Priority Data

Mar. 14, 1995 [JP] Japan ..... 7-054730

[51] Int. Cl.[6] ..... G03G 15/20

[52] U.S. Cl. ..... 399/327

[58] Field of Search ..... 399/326, 327, 399/324, 325; 219/216; 118/60

[56] References Cited

U.S. PATENT DOCUMENTS

| | | | |
|---|---|---|---|
| 4,018,555 | 4/1977 | Thettu . | |
| 4,136,613 | 1/1979 | Namiki | 118/60 |
| 4,878,092 | 10/1989 | Arai | 355/285 |
| 5,221,948 | 6/1993 | Dalal . | |
| 5,287,155 | 2/1994 | Arai et al. | 355/285 |

FOREIGN PATENT DOCUMENTS

| | | |
|---|---|---|
| 57-86873 | 5/1982 | Japan . |
| 61-86776 | 5/1986 | Japan . |
| 63-291076 | 11/1988 | Japan . |
| 63-300272 | 12/1988 | Japan . |
| 63-300273 | 12/1988 | Japan . |
| 1-139266 | 5/1989 | Japan . |
| 6-282195 | 10/1994 | Japan . |

*Primary Examiner*—Robert Beatty

*Attorney, Agent, or Firm*—Oblon, Spivak, McClelland, Maier & Neustadt, P.C.

[57] ABSTRACT

In a fixing device which has a fixing roller, a first cleaning roller and, a second cleaning roller which is in contact with said first cleaning roller, rotational centers of the first cleaning roller, the second cleaning roller and the fixing roller are on the same straight line and the first cleaning roller and the second cleaning roller are movable along the straight line.

4 Claims, 1 Drawing Sheet

FIXING DEVICE WITH CLEANING DEVICE FOR CLEANING FIXING ROLLER

BACKGROUND OF THE INVENTION

1. Field of the Invention

This invention relates to a fixing device which is used in an image forming apparatus such as a copying machine, plotter, laser printer or facsimile machine. The invention further relates to cleaning rollers which remove toner from a fixing roller.

2. Discussion of the Related Art

In a conventional fixing device which has a pair of heated fixing rollers, a paper sheet is passed through the fixing rollers and toner on the paper sheet is fixed. A first cleaning roller is provided so as to contact a surface of one of the fixing rollers and a second roller is disposed as in contact with a surface of the first cleaning roller.

Such a fixing device is well-known, and provided in an image forming apparatus such as a printer, copier or facsimile machine which uses pulverulent toner. This heat roller type of fixing device melts and fixes toner on a paper sheet by heat from the fixing roller. However, if the releasing ability of the fixing roller is low, part of the toner attaches onto the fixing roller and is transferred onto a subsequent paper sheet. This is known as the toner offset phenomenon. A cleaning mechanism is typically provided to clean toner which is attached onto the fixing roller in order to prevent the toner offset phenomenon. A roller type of cleaning mechanism is often used.

The roller type of the cleaning mechanism has a first cleaning roller which rotates in contact with a fixing roller and a second cleaning roller which is in contact with the first cleaning roller. Negative toner attached to the fixing roller is transferred onto the first cleaning roller by the electrostatic adhesion force of the first cleaning roller. That is, since the quantity of negative charges on the fixing roller is much greater than that of the first cleaning roller, a force arises which transfers toner on the fixing roller to the first cleaning roller. The toner is then transferred onto the second cleaning roller whose releasing ability is lower than that of the first cleaning roller.

In the conventional fixing device, a pressing member is provided at both ends of the first cleaning roller to contact the first cleaning roller and with the fixing roller and with the second cleaning roller in order. However, since the first cleaning roller is made of rubber with a small diameter, the cleaning roller tends to sag at its center portion. Accordingly, the pressure falls at the center portion of the first cleaning roller, so that it is difficult to clean toner from around the center portion, and so the cleaning roller does not work well.

SUMMARY OF THE INVENTION

It is an object of the present invention to overcome the above and other problems encountered in the aforementioned art.

It is a further object of the present invention to provide a fixing device capable of removing toner from the fixing roller.

It is another object of the present invention to provide a fixing device capable of maintaining a high cleaning performance of the first cleaning roller.

It is a further object of the present invention to provide a fixing device capable of reducing sagging of the cleaning roller.

It is yet a further object of the present invention to provide a fixing roller which can be sufficiently cleaned.

The above, and other, objects of the present invention are achieved by a fixing device which includes a fixing roller, a first cleaning roller extending parallel to the fixing roller and positioned such that a circumferential periphery of the first cleaning roller engages a circumferential periphery of the fixing roller and a second cleaning roller extending parallel to the first cleaning roller and positioned such that a circumferential periphery thereof is in contact with the first cleaning roller. Rotational centers of the first cleaning roller and second cleaning roller are on a single straight line and the first cleaning roller and said second cleaning roller are movable along the straight line. It is thereby possible to reduce sagging of the cleaning roller and assure sufficient cleaning.

BRIEF DESCRIPTION OF THE DRAWING

Other objects and further features of the present invention will become apparent from the following detailed description when read in conjunction with the accompanying drawing, wherein.

DESCRIPTION OF THE PREFERRED EMBODIMENT

Figure 1:
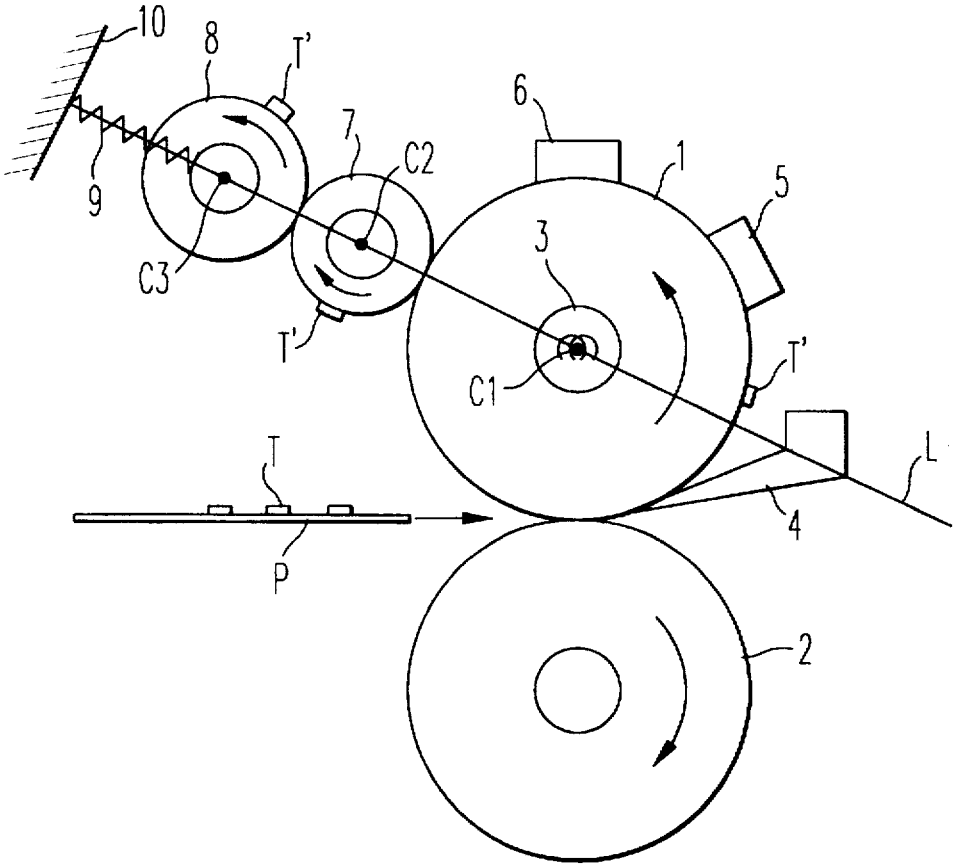
FIG. 1 is a schematic end view of a fixing device according to an embodiment of the present invention.

FIG. 1 is a schematic end view of a fixing device according to an embodiment of the present invention.

In FIG. 1, a fixing device has a fixing roller 1 in which a heater 3 as a heat source is built and a pressing roller 2 which is in pressing contact with the fixing roller 1. The fixing roller 1 and the pressing roller comprise a pair of fixing rollers. Both the fixing roller 1 and the pressing roller 2 are rotatably mounted via bearings (not shown). The fixing roller 1 is rotated by a driving force transmitting device such as gears. Separating picks 4 are provided to prevent paper sheets P from winding around the fixing roller 1. A thermistor 5 as a temperature detecting device and a temperature fuse 6 as an excess temperature limit protection unit are also provided around the fixing roller 1.

A first cleaning roller 7 which is an elastic roller (such as rubber roller) is provided in contact with the circumferential periphery of the fixing roller 1 along the entire length of the fixing roller 1. The second cleaning roller 8 which is a metal roller is mounted so as to contact the periphery of the first cleaning roller 7. The second cleaning roller 8 rotatingly follows the first cleaning roller 7.

In the above described fixing device, a paper sheet P with non-fixed toner T is passed through a nip between the fixing roller 1 and the pressing roller 2. The toner T on the paper sheet P is there heated and pressed by the fixing roller 1 and the pressing roller 2 so that the toner T is fixed on the paper sheet P. A slight quantity of toner will remain on the fixing roller 1 instead of being fixed on the paper sheet P. Since the remaining toner T' on the fixing roller 1 is charged negative, it is transferred onto the first cleaning roller 7 from the fixing roller 1 by the electrostatic adhesion force of the first cleaning roller 7, which is created because the quantity of negative charges on the fixing roller 1 is much greater than that on the first cleaning roller 7. The toner T' which has been transferred onto the first cleaning roller 7 is transferred onto the second cleaning roller 8 from the first cleaning roller 7, because the releasing ability of the second cleaning roller 8 is lower than that of the first cleaning roller 7, and is stuck onto the second cleaning roller 8.

However, since the hardness of the first cleaning roller 7 is lower than that of the fixing roller 1 and the second cleaning roller 8, the first cleaning roller sags, and so contact along the entire lengths of rollers 1 and 7 or 7 and 8 becomes insufficient. Accordingly, insufficient cleaning occurs.

Rotational centers of the fixing roller 1, the first cleaning roller 7 and the second cleaning roller 8 are represented as C1, C2 and C3. The first cleaning roller 7 and the second cleaning roller 8 are mounted relative to the fixing roller 1 such that the centers of rotation C1, C2 and C3 are on the same straight line.

The first cleaning roller 7 and the second cleaning roller 8 are mounted so as to be movable along a straight line L by a slot (not shown).

According to the above described structure, it is possible to reduce sagging of the first cleaning roller 7 and to preventing insufficient cleaning.

In the fixing device according to the present invention, the first cleaning roller 7 is supported so as to be freely movable along the straight line. An end of a compression spring 9 as a pressing member is fixed on a frame 10 and the other end of the spring is in contact with the second cleaning roller 8. The first cleaning roller 7 which is supported freely is in pressing contact with the fixing roller 1 by the pressure of the compression spring 9. That is, the second cleaning roller 8 is pressed onto the first cleaning roller 7 by the pressure of the compression spring 9 and then the first cleaning roller 7 is pressed onto the fixing roller 1. The moving direction of the first cleaning roller 7, the second cleaning roller 8 and the compression spring are the same. That is, the moving direction of the first cleaning roller 7, the second cleaning roller 8 and the pressing direction of the compression spring 9 are along the straight line L.

Since the first cleaning roller 7 is pressed onto the fixing roller 1 by the pressing force from the second cleaning roller 8 whose hardness is greater than that of the first cleaning roller 7, the first cleaning roller 7 is pressed along its entire length by the second cleaning roller 8, thereby it is possible to prevent sagging and prevent insufficient cleaning.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A fixing device comprising:

a fixing roller;

a first cleaning roller extending parallel to said fixing roller and positioned such that a circumferential periphery of said first cleaning roller engages a circumferential periphery of said fixing roller; and a second cleaning roller extending parallel to said first cleaning roller and positioned such that a circumferential periphery thereof is in contact with said first cleaning roller, wherein rotational centers of said first cleaning roller and second cleaning roller are on a single straight line and said first cleaning roller and said second cleaning roller are movable along said straight line, wherein a rotational center of said fixing roller is on said line.

2. A fixing device according to claim 1, including a pressing member which presses said second cleaning roller onto said first cleaning roller.

3. A fixing device according to claim 2, wherein said pressing member presses said first cleaning roller onto said fixing roller.

4. A fixing device according to claim 2, wherein said pressing member is a spring.

* * * * *